US005342217A

United States Patent [19]

Hofmann

[11] Patent Number: 5,342,217

[45] Date of Patent: Aug. 30, 1994

[54] ELECTRIC SWITCH UNIT, IN PARTICULAR FOR AUTOMOTIVE VEHICLES

[75] Inventor: George Hofmann, Heilbronn-Horkheim, Fed. Rep. of Germany

[73] Assignee: SWF Auto-Electric GmbH, Fed. Rep. of Germany

[21] Appl. No.: 68,469

[22] Filed: May 27, 1993

[30] Foreign Application Priority Data

May 30, 1992 [DE] Fed. Rep. of Germany ..... 4217976

[51] Int. Cl.[5] ..... H01R 13/58

[52] U.S. Cl. ..... 439/459

[58] Field of Search ..... 439/456, 459, 76, 67, 439/77, 460, 465

[56] References Cited

FOREIGN PATENT DOCUMENTS

| | | | |
|---|---|---|---|
| 102798 | 3/1984 | European Pat. Off. | 439/459 |
| 2607702 | 9/1977 | Fed. Rep. of Germany . | |
| 8523264 | 11/1985 | Fed. Rep. of Germany . | |
| 3041938 | 5/1987 | Fed. Rep. of Germany . | |
| 8701965 | 5/1987 | Fed. Rep. of Germany . | |

*Primary Examiner*—Gary F. Paumen

*Attorney, Agent, or Firm*—Robert P. Seitter; J. Gordon Lewis

[57] ABSTRACT

An electric switch unit for automotive vehicles providing strain-relieving means for exiting cables, particularly flat cables, which control the exit of the cable to a present exit angle.

9 Claims, 1 Drawing Sheet

ELECTRIC SWITCH UNIT, IN PARTICULAR FOR AUTOMOTIVE VEHICLES

BACKGROUND

The invention is related to an electric switch unit for automotive vehicles in which a cable, particularly a flat cable, leaves the housing. More particularly, the invention relates to an electric switch unit in which the housing is provided with a strain relieving means such that the exit of the cable from the housing is realized at a preset exit angle.

Electric units, also switch units, are known in which it is of special importance that the cable leaving the housing be strain-relieved within the housing in such a way that the functioning of the unit is not impaired or even interrupted by the strains acting on the cable from the outside. Strain-relieving means are known which are self-contained components in electric units such as miniature motors, electric switches and other similar devices. It is a disadvantage of these solutions that the strain-relieving means are incorporated as a self-contained component part into another component part, thereby increasing cost and assembly efforts.

From the German patent application No. G 87 01 965.5 a strain relieving means is known which is composed of two parts fitting into each other leaving a free space between them for the insertion of a cable. Beyond the disadvantage of the separate component, this solution presents a relatively sophisticated shape. Moreover, the cable needs to be pressed into the free space between the two parts, such that tight cable routing must be observed in this context.

A further strain-relieving means is known from the German patent application No. 2,607,702 in which a cable is turned around a separate element several times. Although this strain-relieving unit works very reliably, a great deal of space is occupied by the assembly.

In German patent application No. G 85 23 264.5, a lamp holder with a strain-relieving component molded to the lamp holder is described. The mode of operation of this strain-relieving device mainly consists of the cable being turned around the strain-relieving device.

In addition, a plug-in connection with a strain-relieving means is known from German patent No. 3,041,938 C2 in which, similar to the other strain relieving means, the cable is turned around the strain-relieving means several times. As a result, tractive forces which may occur are transformed into frictional forces at the deviating points with the consequence that no remarkable tractive forces come to act on the cable. In the patent specification, various cable exit angles from the housing are disclosed but a limitation is chosen in favour of two possibilities of cable exit, longitudinally and vertically to the housing of the electrical assembly. In the case of unsheathed cables, the exit of the cable at a determined angle can be reliably realized when the free end of the cable is subjected to a tractive force. Only then will the cable adhere to the edge of the housing exit such that the exit angle can be determined.

Without the free end of the cable undergoing the tractive force, the angle of exit of the cable from the housing cannot be stably adjusted. Sheathed cables can be fixed within the housing at their sheathing. As a result, two exit angles, disposed vertically with respect to each other, can be realized.

It is a common characteristic of all strain-relieving means that they fail to provide a reliable way to realize a cable exit at any optional and preset angle. Consequently, the cable must be deviated into the desired direction upon its exit from the housing, which in the case of delicate electronic elements, may even lead to their destruction. Disadvantageously, the cable leaving the housing must be subjected to a tractive strain to be bent into a desired direction, so as to be assembled at a preset angle.

SUMMARY OF THE INVENTION

Hence, is the object of the present invention to design an electric switch unit of the kind under review in such a manner that its strain-relieving means, while featuring a simple and cheap set-up in terms of manufacturing techniques, permits a cable exit from the housing at a preset angle.

This object is attained by furnishing the switch housing cover with a fin-shaped wall having an extended shape in the direction transverse to the length of the flat cable around which the flat cable is turned and providing the functional portion of the housing with projections in the range of the cable exit which have slanted surfaces for determining a preset exit angle for the cable.

Thanks to this design, an electric switch unit with a strain-relieving means is realized in which, a simple arrangement of strain-relieving elements of both housing parts, prevents forces acting upon the cable section positioned outside the housing from being transmitted to the electric unit and its delicate electric contacts. Additionally this design realizes a simple of manner of exit of the cable from the housing at a predetermined angle, which is of special importance for the connection of the switch unit to other electrical parts. This advantageous strain-relieving effect is achieved by especially simple design measures by the arrangement of an extended, fin-shaped wall at the housing cover part and by the provision of projections at the functional housing part in the range of the exit of the cable. The projections interact with the fin-shaped, extended wall of the housing cover. The cable, which is connected to the electric unit disposed in the housing, is deviated around the fin-shaped wall and tightly adheres to it. In the range of the exit of the cable from the housing, the housing cover part and the functional housing part are coupled to each other. The cable runs in the slot between the fin-shaped wall of the housing cover part and the lateral wall of the functional housing part. The cable tape, preferably configured as a flat cable, is tightly routed through the slot. The purpose achieved through the interaction of the fin-shaped wall, in particular due to the configuration of the transition from the cover bottom to the straight section, is that the cable leaves the housing at a preset angle.

It is advantageous that the fin-shaped wall of the housing cover is shaped to conform to the housing cover in the configuration of a radius. As a consequence, the cable tape is guided out of the housing over a round surface, so that sharp bends and creases are avoided. At the same time, the result attained by this inventive measure is that with a sole formation of the housing cover, one radius only, different cable exit angles can be provided by different configurations of the projections on the functional housing part.

An especially advantageous configuration of the fin-shaped wall is proposed in which the fin-shaped wall forms a right angle or an angle of 90° with the bottom of the housing cover. Depending on the constructional circumstances of the switch, however, the fin-shaped wall may extend either vertically or angularly from the housing cover toward the interior of the switch unit.

In a further refinement of the invention, an extended-shape pocket is molded to the functional housing part to accommodate the fin-shaped wall with the cable tape disposed around it. The range of the radius of the fin-shaped wall and the edge of said pocket form between them an exit slot for the cable tape.

It is advantageous when the width of the lateral pocket corresponds to the cable width. In this way it is ensured that the tape cannot be sharply bent laterally, being protected as it is by the lateral walls of the pocket.

DETAILED DESCRIPTION OF THE PREFERRED EMBODIMENT

Figure 1:
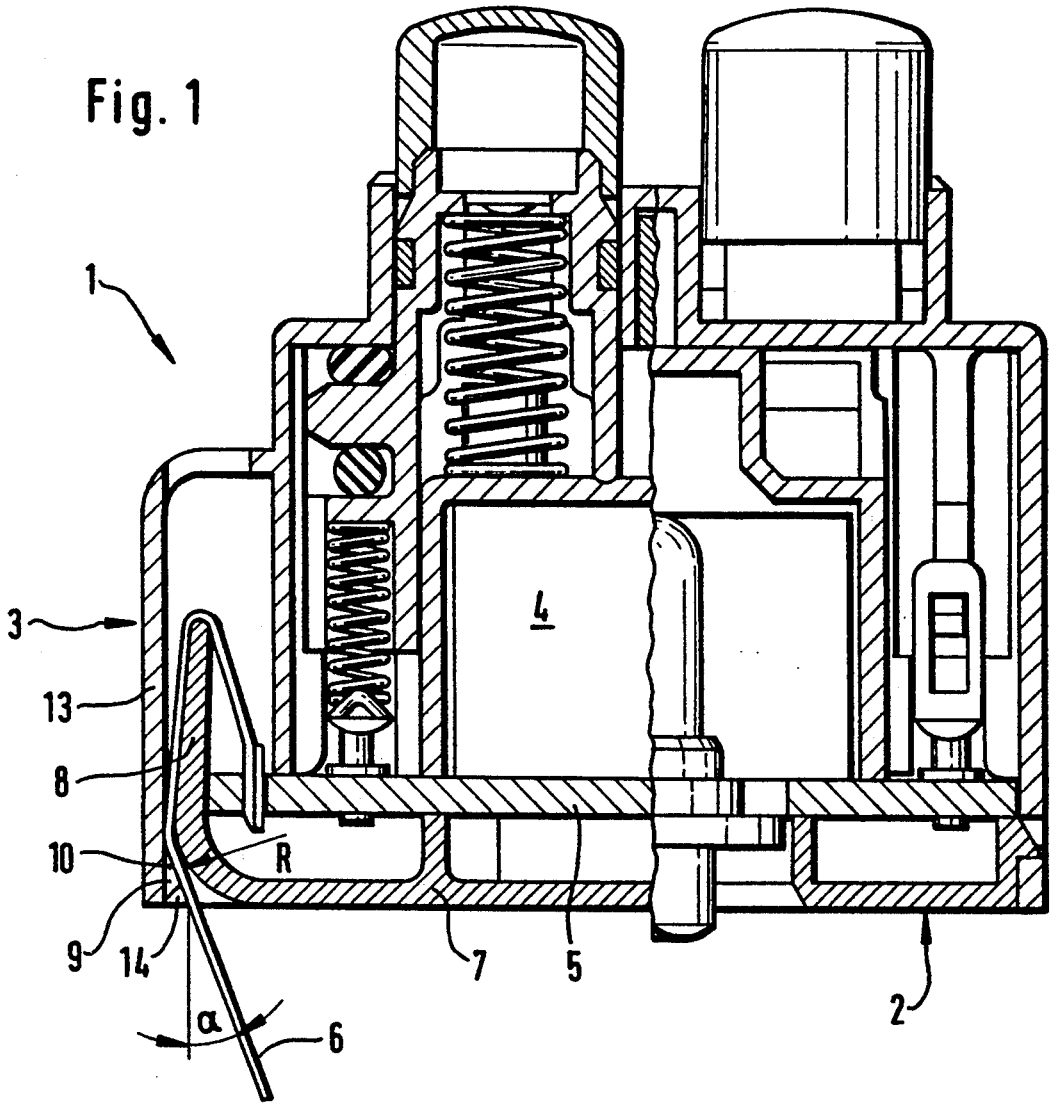
FIG. 1 is a cross-sectional view of an electric switch unit with a strain-relieving means.
Figure 3:
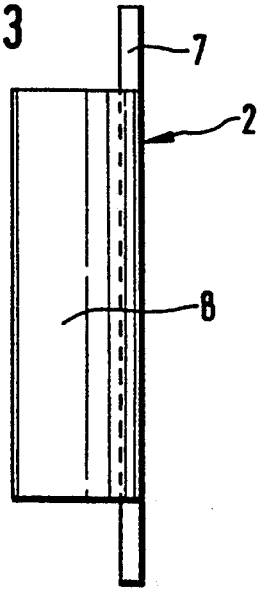
FIG. 3 is a lateral view of the housing cover of FIG. 1.
Figure 2:
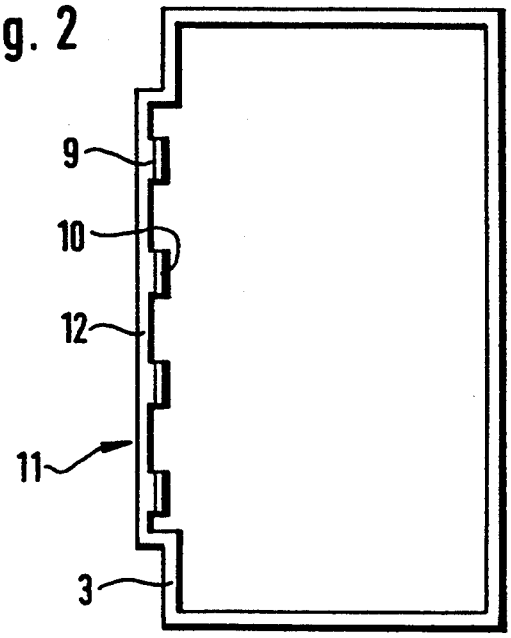
FIG. 2 is a top view of the functional housing part with a pocket molded to it.

The switch unit 1 is comprised of a housing cover part 2 and a functional housing part 3, as well as an electrical unit 4 with a printed circuit board 5. A cable tape 6 is positioned at the printed circuit board 5, the cable tape being a flat cable in the shape of a flexible cord tape. The housing cover 2 comprises a bottom 7 and a fin-shaped, extended wall 8 which is molded to the bottom 7 in the configuration of a radius R. The fin-shaped wall 8 extends vertically or angularly toward the interior of the switch unit 1. The tape-shaped cable 6, starting from the printed circuit board 5, is turned or unwrapped around the fin-shaped wall 8. Projections 9 are disposed at the lateral wall 13 of the functional housing part 3, in the range of exit 14 of the cable 6. The projections 9 have a nose-like shape with at least one slanted surface 10. The slanted surface 10 interacts with the radius R of the fin-shaped wall 8. In this way, the angle of exit $\alpha$ of the cable 6 is determined, or controlled . It will be advantageous when, according to the configuration illustrated in FIG. 2, a pocket 11 with a pocket wall 12 is into molded the functional housing part 3. Projections 9 are arranged on the pocket wall 12 and are engaged by the fin-shaped wall 8 with the cable tape 6 turned around it. The width of the pocket 11 corresponds to the width of the cable 6. A plurality of projections 9 is disposed across the width of the cable 6. The nose projections 9 and the fin-shaped wall 8 form a slot between them for the passage of the cable 6. The preferred angle of exit $\alpha$ of the cable from the housing ranges between 15 degrees and 45 degrees. In the event that the housing cover part and the functional housing part are detachably coupled to each other, openings 15 may be provided in the functional housing part which are engaged by locking noses 16 of the housing cover. Thus the external wall of the housing cover ends flush with the lateral walls of the functional housing part.

What is claimed is:

1. An electric switch unit for automotive vehicles with a housing formed of a housing cover part and a functional housing part, said electric switch having an electric unit accommodated therein and a flat cable attached to said housing, said flat cable wrapped within said housing and wrapped around a strain relief, comprising:

a fin-shaped wall connected to said housing cover having an extended shape in a direction transverse to the extension of said flat cable and around which said flat cable is wrapped, said functional housing part having projections at the exit of said flat cable from said housing, said projections having a slanted surface for controlling the cable exit from said housing to a predetermined angle, wherein said fin-shaped wall is connected to the bottom of said housing cover by a radius, wherein said flat cable extends in approximately a straight line path from a circuit board to an end of said fin-shaped wall wrapping therearound and remaining in contact therewith at the exit from said housing where said cable is in tangential contact with said radius.

2. The electric switch unit in claim 1, wherein said fin-shaped wall forms an angle of 90 degrees with said bottom of said housing cover.

3. The electric switch unit claim 1, further comprising: a pocket molded into a lateral wall of said functional housing part, said pocket projecting outwardly and defining a pocket wall, the pocket wall and said fin-shaped wall forming between them an exit slot for said flat cable.

4. The electric switch unit in claim 3, wherein the width of said pocket and the width of said flat cable tape are equal.

5. The electric switch unit in claim 1, wherein said projections are formed with two slanted surfaces and have the shape of a pointed nose.

6. The electric switch unit in claim 1, wherein the preferred exit angle of said cable from said housing ranges between 15 degrees and 45 degrees.

7. The electric switch unit in claim 1, wherein said functional housing part is furnished with openings which are engaged by locking noses of said housing cover.

8. The electric switch unit in claim 1, wherein the external wall of said housing cover part ends flush with lateral walls of said functional housing part.

9. The electric switch unit in claim 1, wherein said cable exits from said bottom of said housing.

* * * * *